United States Patent [19]

Martinez

[11] Patent Number: 4,723,870

[45] Date of Patent: Feb. 9, 1988

[54] WHEEL ASSEMBLY FOR SOIL COMPACTOR DEVICES

[76] Inventor: Morris P. Martinez, 11540 Elm Ct., Thornton, Colo. 80233

[21] Appl. No.: 819,300

[22] Filed: Jan. 16, 1986

[51] Int. Cl.[4] ..... E02D 3/026

[52] U.S. Cl. ..... 404/121; 301/128

[58] Field of Search ..... 404/117, 121, 122; 301/1, 128

[56] References Cited

U.S. PATENT DOCUMENTS

| | | | |
|---|---|---|---|
| 2,386,946 | 10/1945 | Greiner et al. | 404/122 X |
| 3,817,580 | 6/1974 | Wilson et al. | 301/128 X |
| 3,922,106 | 11/1975 | Caron et al. | 404/121 |
| 4,317,546 | 3/1982 | Lemmon | 301/128 X |

*Primary Examiner*—Stephen J. Novosad

*Assistant Examiner*—John F. Letchford

[57] ABSTRACT

A wheel assembly is disclosed for use with a soil compactor device. The assembly includes a wheel journaled about an axle and carrying a plurality of compacting members at the periphery thereof for compressing soil as the wheel rotates about the axle. A member for mounting the wheel assembly to the compactor device is journaled about the axle. The mounting member is adapted for carrying and rotating the wheel while applying compressive force through the wheel to compact soil with the compacting members. A roller bearing assembly couples the mounting member to the axle and is adapted to absorb both radial and axial loading forces exerted by the wheel and the mounting member. Finally, a mechanism for detachably locking the wheel onto the axle is provided.

25 Claims, 8 Drawing Figures

WHEEL ASSEMBLY FOR SOIL COMPACTOR DEVICES

BACKGROUND OF THE INVENTION 1. Field of the Invention

The present invention generally relates to devices for compacting soil which has been backfilled into ditches during trenching operations for the laying of cable, pipe and the like and, more particularly, to the wheel assemblies utilized with such soil compactor devices. Specifically, the present invention relates to unique wheel assemblies for such devices having improved load bearing systems and wheel locking and attachment mechanisms. 2. Description of the Prior Art In trenching or ditch digging operations for the laying of underground cable and pipe, the ditches must be backfilled once the cable or pipe has been laid within the excavated ditches. This backfilling operation requires proper compaction of the soil, which compaction is governed by very specific federal and state regulations. In particular, federal regulations, where appropriate, require a minimum of 95% soil compaction compared to the original soil. As a result of such requirements, soil compacting devices have evolved to achieve proper compaction of the backfilled soil within ditches.

Such soil compaction devices usually include one or more wheels which carry compacting members or feet on the circumferential edge thereof. The wheels are mounted about an axle generally for free rotation thereabout. The size of the wheel and the size and shape of the compaction feet will vary depending on the width and depth of the ditch which has been excavated. For example, ditches required for the laying of telephone cable and the like are much narrower and shallower than ditches required for the laying of pipeline. Therefore, the size and shape of the compaction feet will vary according to the end use of the soil compaction device. The assemblies carrying the compacting wheels are generally mounted to a hydraulic arm system which in turn is carried at the rear of a ditch excavating machine. A front loader is utilized to backfill the ditches after excavation and laying of the cable or pipe.

Operation of such devices is quite simple. The hydraulic arm system is utilized to roll the freely rotating wheel assembly within the ditch or ditches longitudinally back and forth, thereby compacting the soil due to the weight of the wheel assembly as well as compressive force exerted by the hydraulic arm system. As backfill soil is compacted, additional soil is then added to the ditch which is in turn compacted. Therefore, each wheel is moved higher and higher within the ditch until it is completely filled and compacted relatively uniformly throughout the ditch's depth. It should be noted that the wheel assembly generally also moves laterally a bit within the ditch as it is moved longitudinally therealong to assist in complete compaction of the soil.

While such soil compaction devices have been very successful in meeting the required compaction regulations and are generally efficient during operation, in that one wheel assembly can generally keep up with an excavator and front end loader, certain problems and difficulties have arisen. For example, the compressive force exerted on the soil by the wheel assembly results in sizeable radial loading forces on the axle of the wheel assembly. Likewise, the forces exerted during lateral movement of the wheel assembly within the ditches create substantial axial forces on the wheel axle. These radial and axial loading forces have previously been carried and absorbed by bearing arrangements which have tended to wear out very quickly. For example, certain prior art designs have incorporated brass bushings to distribute the radial forces and brass thrust bearings to absorb the axial or lateral forces. Such brass bushings and thrust bearings tend to wear out quickly as a result of the nature of the material, the sizeable load forces encountered during such backfill operations, as well as the presence of dirt which passes through seals and lodges in the bushing or bearing itself. Such rapid wear and premature failure of bearing arrangements have caused substantial expense as well as down time for existing soil compactor devices.

Another problem encountered with existing soil compactor devices is that of wheel replacement as well as bearing maintenance. Because of the substantial radial and axial loads imposed on the wheel assemblies of such devices, the wheels themselves have generally been permanently welded onto the axle. Consequently, if a compactor foot or some other portion of the wheel becomes broken thereby requiring replacement of the wheel, or if the bearings within the wheel assembly require replacement or maintenance, substantial time and effort is required to remove the permanently mounted wheel in order to either replace it or to gain access to the bearings. In either event, the fact that the wheel has been permanently welded or otherwise mounted to the wheel assembly requires substantial expense and time in terms of maintenance or replacement of parts. However, attempts to provide removable wheels have previously hereto been unsuccessful in that the wheel mounting mechanisms so used have proven incapable of sustaining the load forces imposed thereon over a prolonged period of time in the environment in which the device is used. Thus, there is a need for a mechanism permitting ready removal and/or replacement of wheel assembly components for such soil compactor devices.

SUMMARY OF THE INVENTION

Accordingly, it is one object of the present invention to provide an improved soil compactor device for ditch backfill operations.

It is another object of the present invention to provide an improved wheel assembly for soil compactor devices utilized to compress and compact backfilled soil in trenching operations.

It is a further object of the present invention to provide an improved bearing assembly designed to adequately carry the axial and radial forces imposed on the wheel assembly of a soil compaction device.

It is yet another object of the present invention to provide a mechanism for securing the wheels to the wheel assembly of a soil compactor, which mechanism permits ready detachment and removal of the wheels for replacement thereof or access to other wheel assembly components.

To achieve the foregoing and other objects and in accordance with the purpose of the present invention, a wheel assembly for use with a soil compactor device is disclosed. A wheel is journaled about an axle and carries a plurality of compacting members at the periphery thereof for compressing soil as the wheel rotates about the axle. A member for mounting the wheel assembly to the compactor device is provided with the mounting member being journaled about the axle. The mounting member is adapted for carrying and rotating the wheel while applying compressive force through the wheel to compact soil with the compacting members. A roller bearing assembly couples the mounting member to the axle and is adapted to absorb and distribute both radial and axial loading forces exerted by the wheel and the mounting member. Finally, a mechanism is provided for detachably locking the wheel onto the axle.

In one preferred embodiment, an improved bearing assembly is disclosed for use with the aforementioned soil compactor, the bearing assembly securing the mounting member to the axle. The bearing assembly preferably includes a bearing member having an inner race adapted for mounting to the axle, an outer race, and a plurality of substantially cylindrical roller bearing members, including tapered or conical versions thereof, disposed between the races and adapted to carry both radial and axial load forces imposed thereon by operation of the soil compactor.

In yet another preferred embodiment, an improved locking mechanism is disclosed for the wheel assemblies of such soil compactor devices. The locking mechanism includes an outer member adapted for disposition radially about the axle. A pair of inner members are spaced opposite each other and sized and shaped for disposition about the axial radially inwardly of the outer member. A mechanism is further provided for pressing the inner members against the outer member and for axle to secure the inner and outer members relative to each other and the axle. Finally, a mechanism is provided for selectively releasing the inner members to unlock and detach the locking mechanism.

BRIEF DESCRIPTION OF THE DRAWINGS

The features of the present invention which I believe to be novel are set forth with particularity in the appended claims. The invention, together with further objects and advantages thereof, may best be understood by reference to the following description taken in conjunction with the accompanying drawings and in which:

DETAILED DESCRIPTION OF THE PREFERRED EMBODIMENTS

Figure 1:
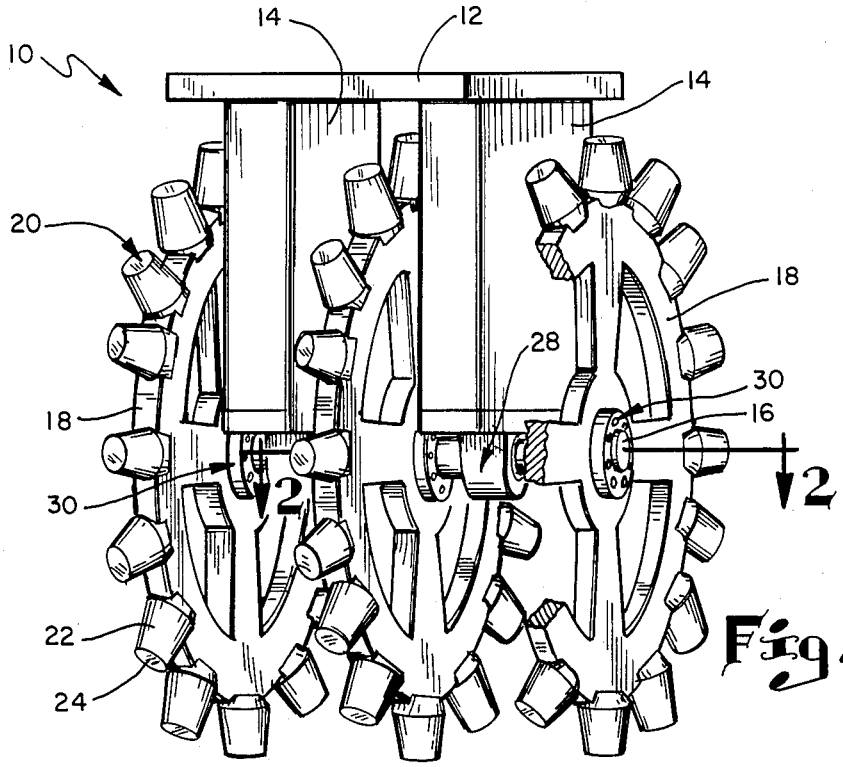
FIG. 1 is a front perspective view, with some parts cut away, of a soil compactor wheel assembly utilized with the present invention.

Referring first to FIG. 1, a soil compactor wheel assembly 10 is disclosed. The assembly 10 generally includes a mounting plate 12 for attachment to a hydraulic arm system or the like (not illustrated) which is preferably carried by the rear end of an excavating machine. The hydraulic arm through the plate 12 moves the assembly 10 longitudinally along excavated trenches to compact the backfill soil placed therein by a front end loader or other similar type device after a cable or pipe has been laid within the trench.

Plate 12 preferably includes one or more mounting arms 14 which are journaled to an axle 16 which carries one or more compactor wheels 18. Each of the compactor wheels 18 includes a plurality of compactor feet 20 which may take several forms. The forms illustrated in FIG. 1 are commonly known as sheep's feet, each of which includes a truncated cone shaped portion 22 and a concave end portion 24. The end portions 24 are concave to prevent the edge of the feet 20 from wearing faster than the center which process would reduce the compaction capability of the members 20. Another typical version of the compaction member 20 includes that of a flat rectangular block 26 (see FIG. 4). Such block members 26 are generally fairly narrow in width and are generally utilized when narrow trenches are being excavated for the laying of cable. The sheep's feet 20 of FIG. 1 are preferably utilized for the compaction of backfilled soil in ditches excavated for the laying of pipes, since more substantial lateral movement is generally involved in such applications.

Figure 2:
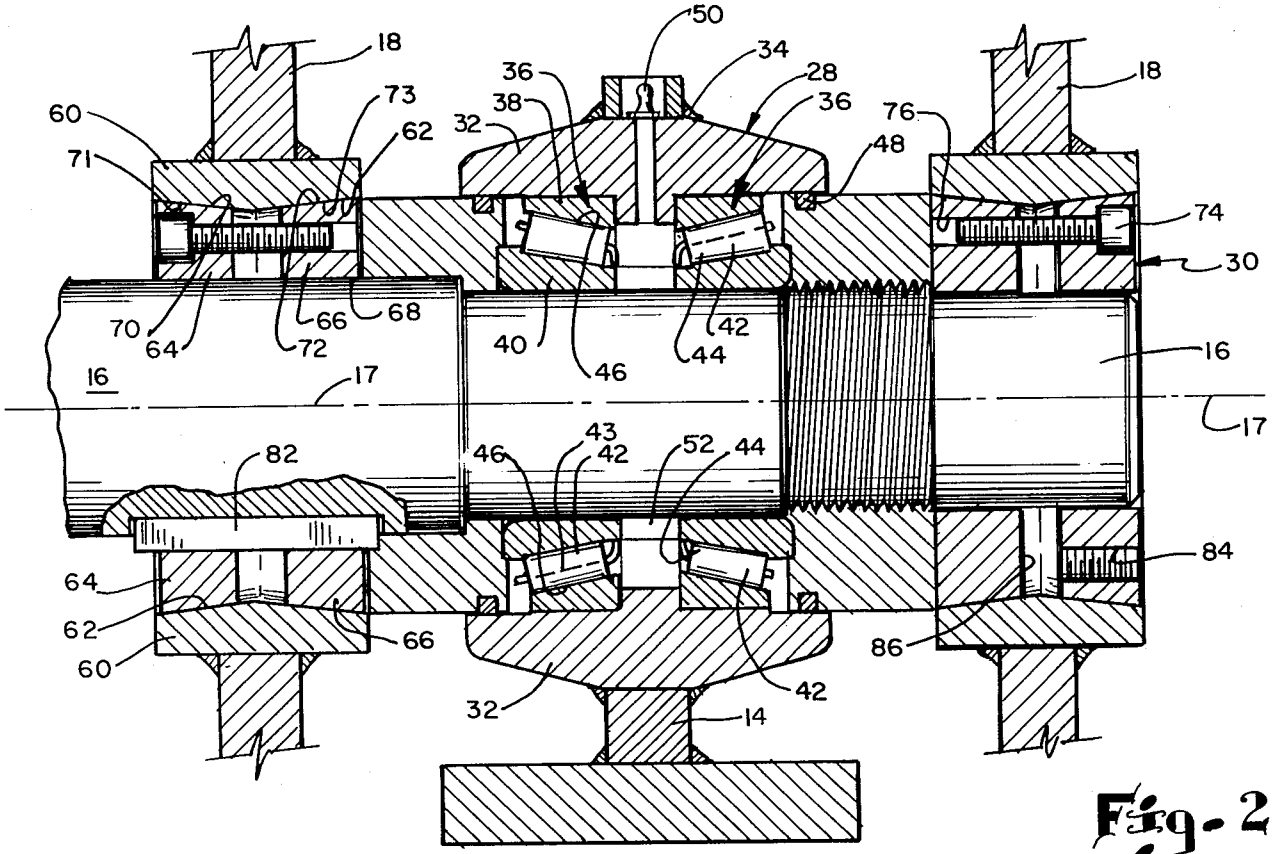
FIG. 2 is a cross-sectional view of the bearing assembly and locking mechanism of one embodiment of the present invention taken substantially along line 2—2 of FIG. 1.

Referring in particular to FIGS. 1 and 2, each mounting arm 14 is preferably journaled about the axle 16 by a bearing assembly 28. Moreover, the wheels 18 are preferably mounted about the axle 16 and locked into place by a locking mechanism 30, to be discussed in greater detail below. Referring particularly to FIG. 2, each bearing assembly 28 preferably includes a bearing housing 32 which is mounted to mounting arm 14 by spot welds 34. However, any desired mechanism for mounting the bearing housing 32 to the arm 14 may be utilized. In preferred form, each bearing assembly 28 includes a pair of bearing members 36 encased within the housing 32. The bearing members 36 are secured to the bearing housing 32 as well as the axle or shaft 16 and are designed to carry and distribute both the radial loads imposed by the compressive force exerted through the mounting arm 14 as well as the axial loads imposed by the lateral movement of the wheels 18.

In preferred form, each bearing member 36 includes an outer race 38 secured to the mounting arm 14 through the housing 32, and an inner race 40 which is secured to the axle 16 for rotation therewith. Disposed between the inner and outer races 40, 38, are a plurality of substantially cylindrical roller members 42, including tapered or conical versions thereof as described below. Each roller member 42 is inclined at an angle relative to the axis 17 of the axle 16. Preferably, the axis 43 of each roller bearing member 42 is approximately 5°–30° relative to the axis 17, depending upon the relative amount of axial and radial forces to be imposed upon the assembly 28 and the roller members 42. The spaced bearing members 36 are arranged in mirror image fashion whereby the radially inner ends 44 of the roller members 42 are spaced closest to each other in the opposing bearing members 36.

In preferred form, each substantially cylindrical roller member 42 is in the form of a truncated cone tapered toward its radially inwardly disposed end 44. It is to be understood that the term "substantially cylindrical" is deemed to include cylindrical form as well as tapered and conical versions thereof as specifically illustrated herein. As an example, the bearing member 36 is composed of a cup and cone arrangement manufatured by Timken, a trademarked product. The angle of inclination of the roller members 42 relative to the axis 17 as well as the taper of the conical outer surface 46 of the roller members 42 permit the roller members 42 to bear and distribute both the radial as well as the axial forces imposed thereon by operation of the wheel assembly 10. Thus, separate bearing systems are not necessary for each of these loads. A grease seal 48 and grease fitting 50 are provided to permit proper lubrication of the roller members 42 within each bearing member 36. A bearing spacer 52 is also provided for proper spacing of the oppositely disposed bearing members 36.

Figure 3:
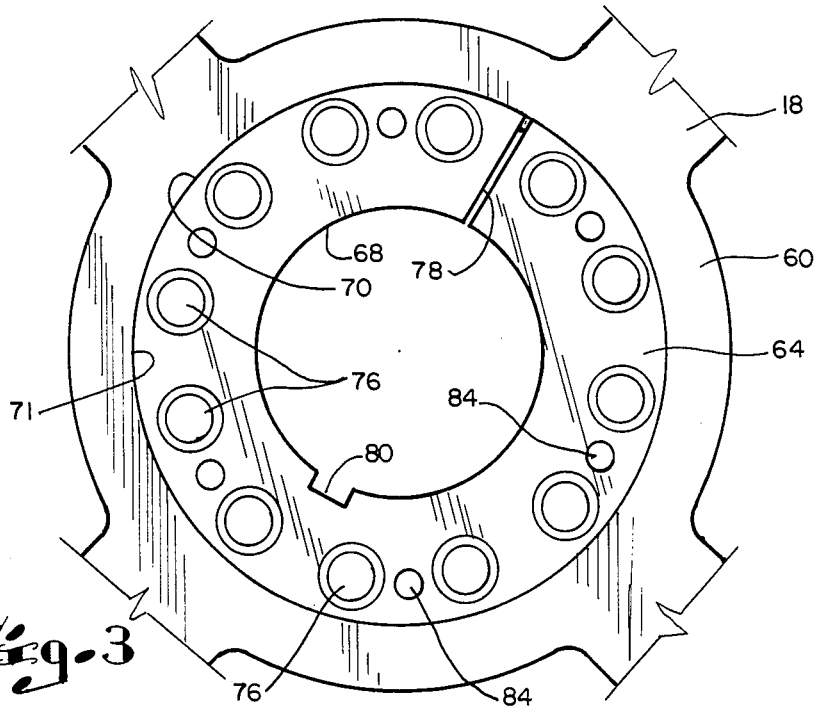
FIG. 3 is a side view of the hub area of the wheel assembly of FIG. 2 illustrating one embodiment of the locking mechanism thereof.

Referring now to FIGS. 2 and 3, a mechanism 30 is disclosed for detachably locking the wheels 18 to the shaft 16 for rotation therewith. Such a mechanism permits ready removal of the wheel 18 for replacement thereof or for easy access to the bearing assembly 28 for maintenance or replacement of component parts thereof. In one preferred embodiment of the invention, the locking mechanism 30 includes an outer member 60 which is either secured to the wheel 18 or itself comprises the actual hub of the wheel 18. In preferred form, the outer member 60 is in the form of an annular ring having a radially inner surface 62.

The locking mechanism 30 further includes a pair of oppositely disposed inner members 64, 66 which are sized and shaped for positioning about the axle 16 radially inwardly of the outer member 60. In preferred form, each of the inner members 64, 66 is identical in size and construction and is in the form of an annular ring. The radially inner surface 68 of each ring 64, 66 is sized to slidingly fit about the axle 16. The radially outer peripheral surfaces 70, 72 of the rings 64, 66 are sized and shaped to fit against the inner surface 62 of the outer member 60. In preferred form, the outer circumferential surfaces 70, 72 of the rings 64, 66 are beveled inwardly so as to face each other as illustrated in FIG. 2, the ring 64 being the mirror image of the ring 66. The angle of inclination of the beveled surfaces 70, 72 is generally less than about 20° and preferably less than about 16.5° relative to the axis 17 of the axle 16. The most preferred angle of bevel is about 7°. Since the preferred construction of the inner members 64, 66 include beveled surfaces 70, 72, the inner surface 62 of the outer member 60 includes beveled portions 71, 73 which are oriented for matching the circumferential beveled surfaces 70, 72 of the inner ring members 64, 66 when the locking mechanism is engaged. In this manner, the rings 64, 66 may be wedged tightly between the axle 16 and the outer member 60 as further described below.

In order to engage the locking mechanism 30, the inner ring members 64, 66 are drawn or pulled toward each other. When this occurs, and as a result of the preferred beveled surfaces 70, 72 and the opposing beveled portions 71, 73 of the surface 62, the rings 64, 66 wedge themselves and press fit against the axle 16 as well as the inner surface 62 of the outer member 60. To achieve this operation, a plurality of attachment members in the form of bolts 74 are provided. Each of the inner ring members 64, 66 includes a plurality of apertures 76 extending therethrough, the apertures 76 of ring 64 being coaxially aligned with the apertures 76 of the ring 66. Consequently, the bolts 74 are inserted through and secured to the first inner member 64 and are then engaged within the apertures 76 of the oppositely facing inner member 66. When the bolts 74 are tightened down, the inner members 64, 66 are drawn together. Since the inner ring members 64, 66 are preferably constructed from stainless steel or other similarly hard material, the inner members 64, 66 may be tightly wedged and press fitted against the axle 16 and the outer member 60 so as to firmly secure the wheel 18 for rotation with the axle 16. In order to permit such firm attachment and retain the same during operation of the device 10, there are preferably at least twelve bolts 74 which are sized sufficient to withstand the stress and loads imposed thereon by operation of the device 10. Preferably, the bolts 74 are at least ⅜ inch bolts.

Referring in particular to FIG. 3, each of the inner members 64, 66 are preferably in the form of split rings having a split or gap 78 cut entirely therethrough. This split ring design is preferred so that as the ring members 64, 66 are drawn toward each other within the outer member 60 and tightly wedged between the outer member 60 and the axle 16, the diameter of the rings 64, 66 is reduced and the gap 78 is reduced and even entirely eliminated. This arrangement permits substantially large compressive forces to be built up between the rings 64, 66 and the axle 16 and the outer member 60.

To further insure that the inner members 64, 66 firmly seat between the outer member 60 and the axle 16 and remain stationary relative to the axle 16, a keyway 80 is provided within each ring 64, 66. The keyway 80 is sized and shaped to receive a key 82 which is disposed along the outer surface of the axle 16. As a result of the above construction and arrangement, the inner rings 64, 66 may be drawn together to firmly engage the axle 16 to the wheel 18, which construction is designed to readily withstand the operational loads imposed thereon.

Since the above described press fit or wedging relationship between the inner ring members 64, 66 and the axle 16 and outer member 60 is so strong, once the locking mechanism 30 is fully engaged to attach the wheel 18 to the axle 16, mere removal of the bolts or other attachment members 74 from the rings 64, 66 is generally not sufficient to permit removal and separation of the rings 64, 66 and therefore removal of the wheel 18 from the axle 16. Consequently, a mechansim for separating the rings 64, 66 and therefore detaching the wheel 18 from the axle 16 is preferably provided. In preferred form, the separating mechanism comprises an arrangement whereby a plurality of additional apertures 84 are provided in the first ring 64 which is spaced axially outwardly relative to the second ring 66. However, matching and aligned apertures are not provided in the second ring 66 as with the aperture arrangement 76 for the bolts 74. Thus, the apertures 84 are spaced across from the surface of the ring 66. When it is desired to separate the rings 64 and 66, the bolts 74 are first removed, and a plurality of appropriately sized bolts or other detachment members are inserted within the apertures 84. When these detachment members are tightened, they contact the axially outer surface 86 of the second inner ring 66. As these bolts are then further tightened, they force the ring 64 away from the ring 66 and thereby separate the rings. This separation of the rings 64, 66 likewise removes the compressive forces established initially by engagement of the locking mechanism 30 and thereby permits removal of the wheel 18 from the axle 16.

Figure 4:
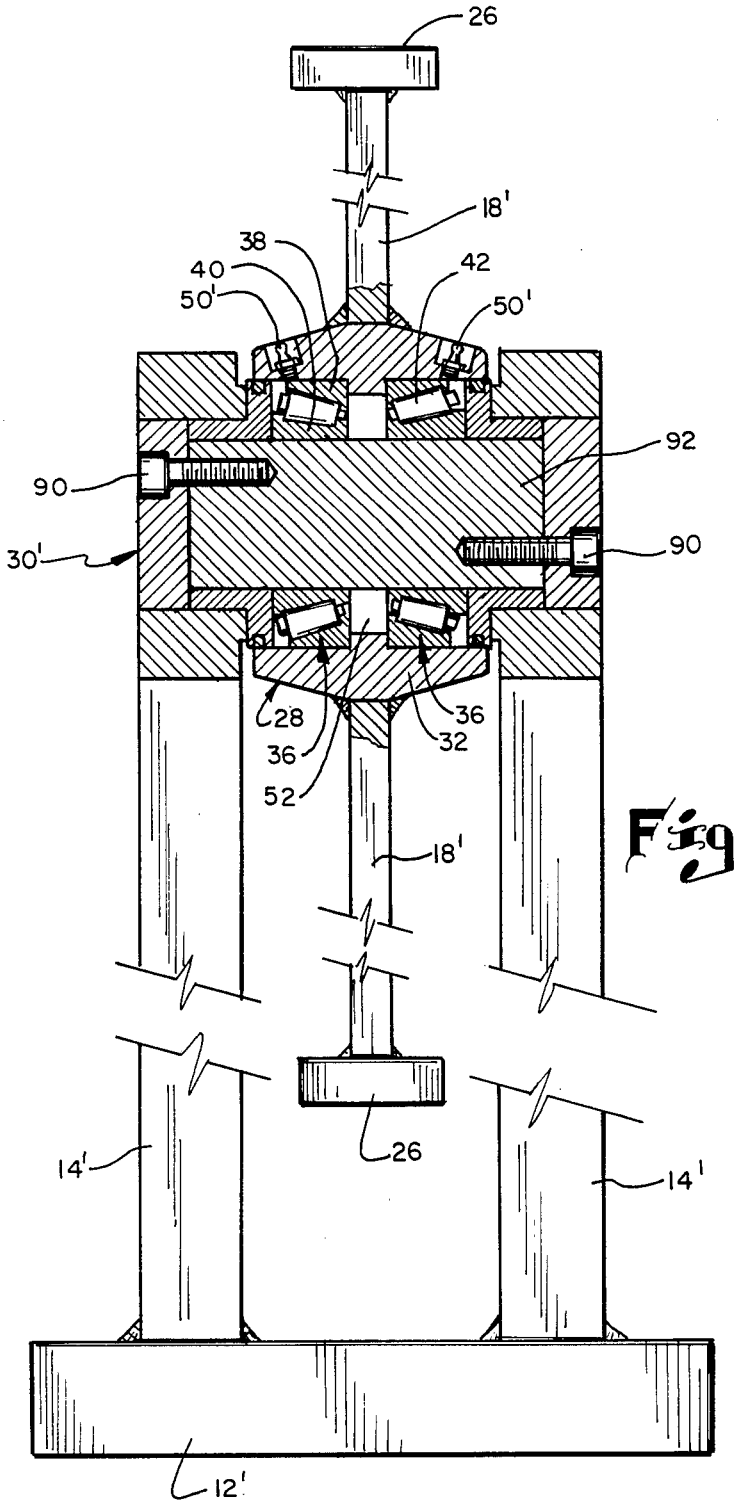
FIG. 4 is a cross-sectional view of a single wheel embodiment of the wheel assembly of the present invention utilizing the bearing assembly disclosed and illustrated in FIG. 2 without the locking mechanism thereof.

Referring now to FIG. 4, an alternate embodiment of the present invention is disclosed herein. In this instance, a single wheel 18' carrying a plurality of flat feet 26 designed for shallow and narrow ditches is attached by way of mounting arms 14' and mounting plate 12' to an appropriate hydraulic operating mechanism. In this arrangement, since only a single wheel 18' is involved for use with shallow and narrow ditches requiring substantially less lateral movement of the wheel 18' as compared to the prior embodiment, the detachable locking mechanism 30' utilized in this embodiment is simply in the form of bolts 90 attaching an axle 92 to the mounting arms 14°. The bearing assembly 28 as previously described is utilized herewith and is designed to absorb and distribute both radial and axial load forces imposed on the axle 92. In this particular embodiment, however, a pair of grease fittings 50° are provided, each bearing member 36 having its own grease fitting 50'.

Figure 5:
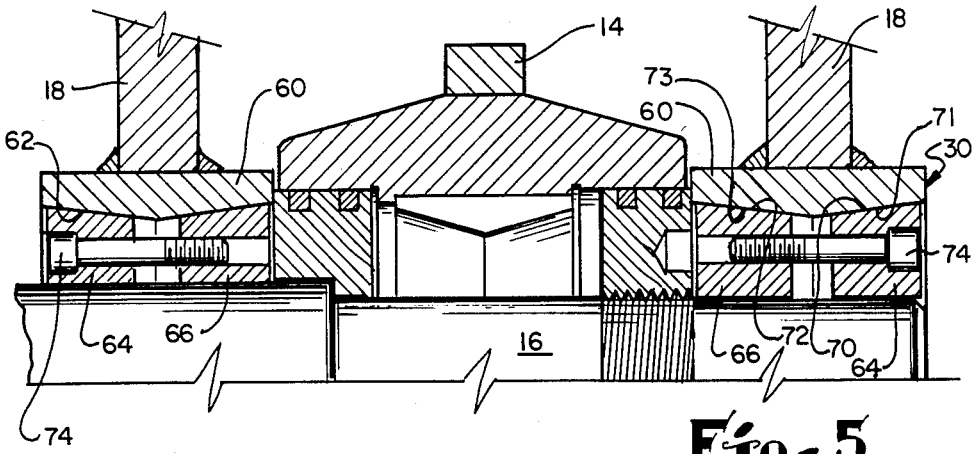
FIG. 5 is a partial cross-sectional view of yet another embodiment of the present invention illustrating the locking mechanism similar to that shown in FIG. 2 without the bearing assembly thereof.

Referring to FIG. 5, yet another embodiment of the present invention is disclosed. In this particular embodiment, the locking mechanism 30 as previously described is utilized to lock and attach each wheel 18 to the axle 16. In this particular embodiment, however, the bearing members 36 of the prior embodiments are not included. This illustration is provided in order to show that the locking mechanism 30 having the outer ring 60 and the inner rings 64, 66 as previously discussed may be utilized without the novel bearing arrangement of the present invention when the anticipated load forces are not great. In this instance, standard bearing and bushing arrangements may be utilized as are well known in the existing art.

The locking arrangement shown and described in FIGS. 1–3 and 5 illustrate one form wherein the outer member 60 is the hub of the wheel 18, and the inner ring members 64, 66 are designed for movement within the entire width of the member 60. In this arrangement, the entire hub 60 of the wheel 18 is subjected to the compressive forces established by the press fit relationship of the inner rings 64, 66 therewithin when the locking mechanism 30 is fully engaged. This is particularly useful in applications where substantial load forces are anticipated. However, there are many present applications and devices wherein the existing wheel structure must be retrofitted and cannot function as described above.

Figure 6:
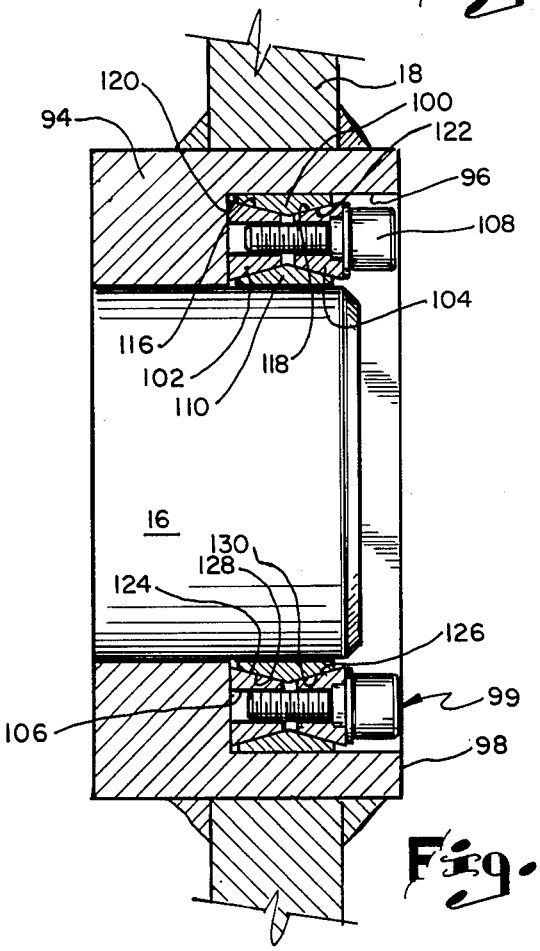
FIG. 6 is a cross-sectional view of the wheel hub portion of yet another locking mechanism embodiment of the present invention.
Figure 7:
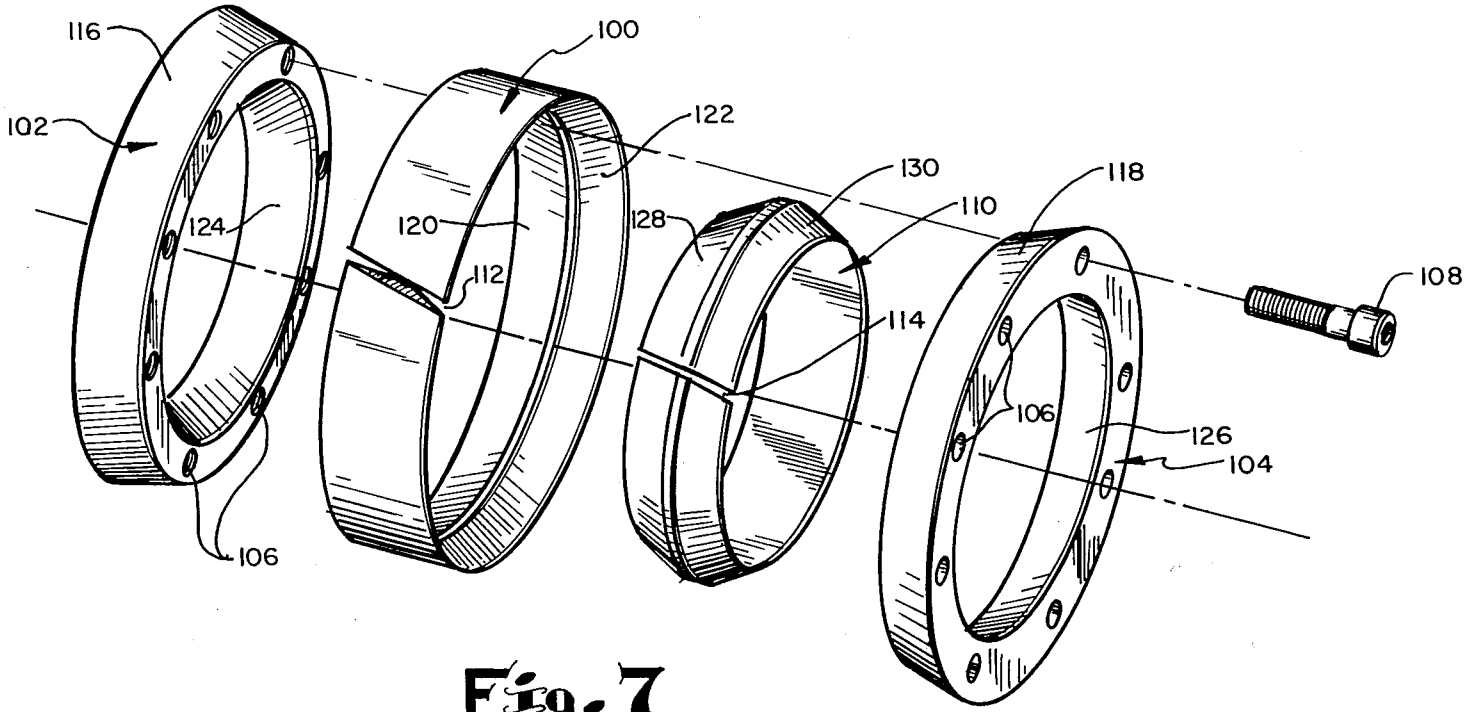
FIG. 7 is an exploded, perspective view of the locking mechanism embodiment illustrated in FIG. 6.
Figure 8:
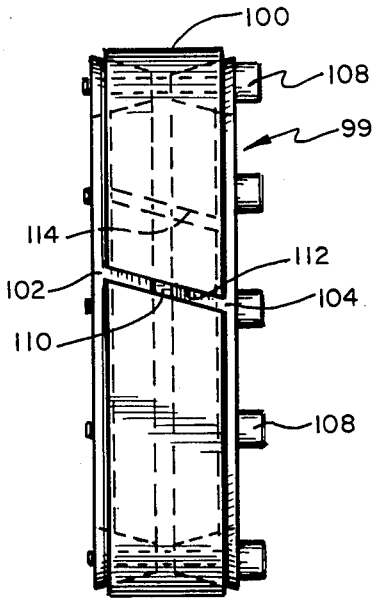
FIG. 8 is a view of the locking mechanism of FIG. 7 in its fully assembled condition.

FIGS. 6–8 illustrate an alternate version of the locking mechanism 30. In this embodiment, the wheel 18 includes a hub member 94 which is mounted about the axle 16. In this particular instance, the hub 94 is mounted about the end of the axle 16. In this embodiment, the wheel hub member 94 includes a recessed portion 96 disposed along the outermost end surface 98 thereof. The recessed portion 96 forms a circular groove immediately about the axle 16 and is positioned in the radially inward portion of the hub 94. A wheel locking mechanism 99 is positioned within the recessed portion 96 and engaged therewithin to firmly lock the wheel hub 94 to the axle 16.

In this embodiment, the locking mechanism 99 is further illustrated in FIGS. 7 and 8 and includes an outer member 100 and a pair of oppositely disposed, spaced apart inner ring members 102 and 104. Each of the ring members, 102, 104 includes a plurality of apertures 106 through which bolts or other similar attachment members 108 may pass so as to draw the ring members 102, 104 together and tighten the locking mechanism 99 similar to the mechanism 30 previously described. However, in this particular embodiment a radially inner-most hub portion 110, which is the counter-part to the outer portion 100, is also provided. Moreover, in this particular embodiment, the inner and outer locking hub members 100, 110 are in the form of split rings having gaps or splits 112, 114, respectively, disposed through the entire width thereof.

The ring members 102, 104 include beveled radially outer circumferential surfaces 116, 118 which are beveled in a manner similar to the surfaces 70, 72 of the embodiment illustrated in FIG. 2. The angles of inclination are in the same preferred range and are most preferably approximately 7° relative to the axis of the axle 16. This is true of all beveled surfaces in this embodiment. The outer-most hub member 100 has counter-part beveled surfaces 120, 122 which are oriented to engage the outer beveled surfaces 116, 118 of the ring members 102, 104.

Unlike the prior embodiments, however, the radially inner surfaces 124, 126 of the ring members 116, 118 are also beveled in a similar fashion and are designed to engage counter-part beveled surfaces 128, 130 of the inner hub member 110. Thus, as the bolts 108 are tightened, the rings members 102, 104 are drawn toward each other. Due to the beveled surfaces 116–130 the rings 102, 104 are tightly wedged between the outer- and inner-most hub members 100, 110 within the recessed portion 96. As the rings 102, 104 are drawn toward each other, the gap 112 present in the outer hub member 100 permits the outer hub member 100 to expand so as to increase its diameter and increase the size of the gap 112. This expansion of the outer hub member 100 creates a compressive force between it and the surface of the recessed portion 96. Likewise, as the inner ring members 102, 104 are drawn toward each other, the diameter of the inner most hub member 100 decreases so as to reduce and even eliminate the gap 114 therein. This likewise creates a compressive force between the inner hub member 110 and the axle 16. Thus, the locking mechanism 99 tightly engages the axle 16 with the wheel hub 94 within the recessed portion 96.

As can be seen from the above embodiments, the present invention provides a novel wheel assembly construction for soil compactor devices which includes an improved bearing arrangement as well as a detachable locking mechanism for the wheels of such assemblies. The bearing arrangement of the present invention provides substantially improved load carrying capability of at least 160,000 pounds and is not subject to the shorter life span of previously utilized bearing systems in such soil compactor devices. Thus, the bearing arrangement not only increases the load carrying capability but also the life of the bearing system.

The present invention also permits ready removal of the wheels from soil compactor devices so as to replace the same or to permit easy access to the bearing system or other components of the soil compactor. Prior to the present invention, such detachable locking mechanisms on these devices were unknown. However, not only does the locking mechanism permit ready wheel detachment, but is designed to withstand the heavy stress and load conditions without loosening thereof. Such design features are paramount under the high stress and load conditions frequently encountered with soil compactor devices of this nature. Thus, the present invention discloses a number of improvements over known soil compacator arrangements which not only improve the load carrying capability thereof, but also extends the useful life of such devices as well as improves ease of maintenance and repair.

It will be understood that the invention may be embodied in other specific forms without departing from the spirit or central characteristics thereof. The present examples and embodiments, therefore, are to be considered in all respects as illustrative and not restrictive, and. the invention is not to be limited to the details given herein but may be modified within the scope of the appended claims.

I claim:

1. A locking mechanism for the wheel assembly of a soil compactor device utilized to compress and compact soil in backfilled ditches, said device including at least one soil compactor wheel possessing a hub journaled about an axle, said locking mechanism comprising:

an outer hub ring for disposition radially about said axle;

a pair of inner members spaced opposite each other and sized and shaped for disposition about said axle radially inwardly of said outer hub ring;

an inner hub ring disposed radially inwardly of said inner members;

means for pressing said inner members against said outer hub ring and said inner hub ring and said axle to firmly secure said inner members and said inner and outer hub rings relative to each other and said axle; and means for selectively releasing said inner members to unlock and detach said mechanism.

2. The locking mechanism as claimed in claim 1, wherein said locking mechanism is adapted for disposition within a radially inwardly recessed portion of said hub, said locking mechanisms being designed to press against the inner circumferential surface of said recessed portion of said wheel hub.

3. The locking mechanism as claimed in claim 1, wherein each said inner member includes a keyway disposed along the radially inner surface thereof adapted for engagement with a key disposed on said axle, thereby aligning said inner members and preventing rotation thereof relative to said axle.

4. The locking mechanism as claimed in claim 1, wherein each said inner and outer hub rings comprise split rings having a gap therein to permit expansion and contraction of the diameter thereof as said inner members are pressed thereagainst.

5. The locking mechanism as claimed in claim 1, wherein the radially outer peripheral surface of each said inner member is beveled radially inwardly toward said axle, the beveled peripheral surfaces of said oppositely spaced inner members being oriented to face each other.

6. The locking mechanism as claimed in claim 5, wherein said inner members are substantially annular in shape, and wherein at least one of said hub rings includes a surface having beveled surface portions oriented for engaging the peripheral beveled surfaces of said inner members in a wedge-like formation to assist said inner members in pressing against said hub rings and said axle when securing said inner members relative thereto.

7. The locking mechanism as claimed in claim 6, wherein said beveled surface portions of said hub rings extend substantially the entire width of said hub to receive and engage the beveled surface of said inner members.

8. The locking mechanism as claimed in claim 6, wherein the angle of inclination of said beveled surfaces relative to the axis of said axle is less than about 20°.

9. The locking mechanism as claimed in claim 8, wherein said angle of inclination is approximately 7°.

10. The locking mechanism as claimed in claim 1, wherein said pressing means comprises means for drawing said oppositely spaced inner members toward each other to press fit said inner members against said hub rings and said axle.

11. The locking mechanism as claimed in claim 10, wherein said pressing means comprises a plurality of attachment members adapted to pull said inner members toward each other.

12. The locking mechanism as claimed in claim 11, wherein said releasing means comprises a plurality of bolts passing through one said inner member for engagement against the oppositely disposed inner member whereby tightening of said bolts urges said inner members away from each other.

13. The locking mechanism as claimed in claim 11, wherein said attachment members comprise a plurality of bolts secured to and passing entirely through one said inner member and secured to the oppositely disposed inner member, whereby tightening of said bolts pulls said inner members toward each other.

14. The locking mechanism as claimed in claim 13, wherein said bolts avoid passing through said wheel hub and said hub rings.

15. The locking mechanism for the wheel assembly of a soil compactor device utilized to compress and compact soil in backfilled ditches, said device including at least one soil compactor wheel having a center hub with a radially inwardly recessed portion, said center hub and said wheel being journaled about an axle, said locking mechanism comprising:

at least one hub ring adapted for disposition radially about said axle within said radially inwardly recessed portion of said center hub;

a pair of inner members spaced opposite each other and sized and shaped for disposition about said axle center hub;

means for pressing said inner members against said hub ring and said axle to firmly secure said inner members relative to each other, said hub ring and said axle; and means for selectively releasing said inner members to unlock and detach said mechanism.

16. The locking mechanism as claimed in claim 15, wherein said hub ring comprises a split ring having a gap therein to permit expansion and contraction of the diameter thereof as said inner members are pressed thereagainst.

17. The locking mechanism as claimed in claim 15, wherein a radially peripheral surface of each said inner member is beveled radially inwardly toward said axle, the beveled peripheral surfaces of said oppositely spaced inner membes being oriented to face each other.

18. The locking mechanism as claimed in claim 17, wherein said inner members are substantially annular in sahpe, and wherein said hub ring includes a surface having beveled surface portions oriented for engaging the peripheral beveled surfaces of said inner members in a wedge-like formation to assist said inner members in pressing against said hub ring and said axle when securing said inner members relative thereto.

19. The locking mechanism as claimed in claim 18, wherein the angle of inclination of said beveled surfaces relative to the axis of said axle is less than about 20°.

20. The locking mechanism as claimed in claim 19, wherein said angle of inclination is approximately 7°.

21. The locking mechanism as claimed in claim 15, wherein said pressing means comprises means for drawing said oppositely spaced inner members toward each other to press fit said inner members against said hub ring and said axle.

22. The locking mechanism as claimed in claim 21, wherein said pressing means comprises a plurality of attachment members adapted to pull said inner members toward each other.

23. The locking mechanism as claimed in claim 22, wherein said releasing means comprises a plurality of bolts passing through one said inner member for engagement against the oppositely disposed inner member whereby tightening of said bolts urges said inner members away from each other.

24. The locking mechanism as claimed in claim 22, wherein said attachment members comprise a plurality of bolts secured to and passing entirely through one said inner member and secured to the oppositely disposed inner member, whereby tightening of said bolts pulls said inner members toward each other.

25. The locking mechanism as claimed in claim 24 wherein said bolts avoid passing through said hub ring and said center hub.

* * * * *